US007954199B2

(12) United States Patent
Kurata

(10) Patent No.: US 7,954,199 B2
(45) Date of Patent: Jun. 7, 2011

(54) DRAIN CLEANER

(76) Inventor: Hideki Kurata, Tokyo (JP)

( * ) Notice: Subject to any disclaimer, the term of this patent is extended or adjusted under 35 U.S.C. 154(b) by 1189 days.

(21) Appl. No.: 10/565,599

(22) PCT Filed: Jul. 22, 2004

(86) PCT No.: PCT/JP2004/010417

§ 371 (c)(1),
(2), (4) Date: Jan. 24, 2006

(87) PCT Pub. No.: WO2005/009195

PCT Pub. Date: Feb. 3, 2005

(65) Prior Publication Data

US 2006/0242776 A1 Nov. 2, 2006

(30) Foreign Application Priority Data

Jul. 24, 2003 (JP) ..... 2003-279005

(51) Int. Cl.
*B08B 7/00* (2006.01)

(52) U.S. Cl. ..... 15/257.01; 15/245; 15/209.1; 15/210.1; 210/924

(58) Field of Classification Search ..... 15/257.01, 15/104.001, 245, 210.1, 209.1; 49/34; 62/235; 405/115; 210/294, 924
See application file for complete search history.

(56) References Cited

U.S. PATENT DOCUMENTS

| | | | | | |
|---|---|---|---|---|---|
| 2,704,190 | A | * | 3/1955 | Schmale et al. | 242/406 |
| 3,330,498 | A | * | 7/1967 | Rucky | 242/391.1 |
| 3,662,969 | A | * | 5/1972 | King | 242/396.5 |
| 3,918,166 | A | * | 11/1975 | Mason | 33/514.2 |
| 5,030,031 | A | * | 7/1991 | Brown | 405/36 |
| 5,406,715 | A | * | 4/1995 | Koizumi et al. | 33/706 |

FOREIGN PATENT DOCUMENTS

| | | |
|---|---|---|
| JP | 2000-033065 | 2/2000 |
| JP | 2000-080608 | 3/2000 |

* cited by examiner

*Primary Examiner* — Shay L Karls
(74) *Attorney, Agent, or Firm* — Manabu Kanesaka

(57) ABSTRACT

A drain cleaner which is superior in portability and which makes it possible for a small number of people to perform drain cleaning operation on a broad floor. A drain cleaner (1) comprises a strip body (2), and a reel body (3) for winging or unwinding the strip body (2). The strip body (2) has a handle (4) at its front end (2*a*), the opposite edges (2*b*, 2*b*) thereof having attached thereto flexible members (20, 20) made of rubber having high adhesion to a floor or the like. Surrounding a puddle on a floor by the strip body (2) unwound from the reel body (3), one of two operators holds the handle (4) of the strip body (2) and the other holds the reel body (3). By pulling the strip body (2), the water in the puddle can be swept by the strip body (2).

3 Claims, 6 Drawing Sheets

DRAIN CLEANER

TECHNICAL FIELD

The present invention relates to a drain cleaner for cleaning up water pooled on the floor of a construction site, factory, etc.

BACKGROUND ART

For example, at a construction site etc., it is necessary to clean up water pooled on the floor of the building etc. so as to remove this obstacle from the construction work.

In the past, a drain cleaner called a "pusher" was used for this cleanup work (for example, Patent Document 1).

FIG. 10 is a perspective view of a conventional drain cleaner, while FIG. 11 is a view of an example of its use.

As shown in FIG. 10, this drain cleaner 100 was comprised of a wide plate member 101 and a handle 102 attached to the center of the back of this plate member 101. As shown in FIG. 11, a worker gripped the handle 102 and pushed the water W of a puddle by the plate member 101 to a predetermined drain etc. to clean up the water.

Patent Document 1: Japanese Patent Publication (A) No. 2000-33065

DISCLOSURE OF INVENTION

Problem to be Solved by the Invention

However, the above-mentioned conventional drain cleaner had the following problem.

Since each drain cleaner 100 is designed to be used by a single worker, there is a limit to widen the plate member 101 in width. For this reason, when there are a large number of puddles or a large puddle on the floor, a large number of workers have to pick up drain cleaners 100 and line up in order to perform the water cleanup work. The work therefore requires manpower and time. Further, the drain cleaner 100 is comprised of a nondeforming plate member 101 and handle 102, so is bulky and poor in portability. This was extremely inconvenient for storage or transport of the drain cleaner 100.

The present invention was made to solve the above problem and has as its object the provision of a drain cleaner superior in portability and enabling water cleanup work of a large floor to be performed by a small number of workers.

Means for Solving the Problems

To solve this problem, the drain cleaner as set forth in the first aspect is provided with an equal width strip body having a handle at its front end and a reel body having a rotary member to which a rear end of the strip body is attached and reeling in or playing out the strip body to or from the rotary member by rotating this rotary member.

By this configuration, two workers can align themselves across a puddle, one worker can grip the handle of the front end of the strip body played out from the reel body, and the other worker can hold the reel body. If, in this state, the strip body is dropped down to the floor and the two workers pass across the puddle, the strip body on the floor will enter the puddle and will be kept standing in the state with its bottom edge brought into contact with the floor at the bottom of the water. Due to this, if pulling the strip body to a predetermined location, the strip body will convey the water of the puddle on the floor to a predetermined location.

Further, the second aspect of the invention provides a drain cleaner as set forth in the first aspect wherein at least one edge of the strip body is provided with a flexible member with a high ability to closely contact a floor etc. along a long direction of the strip body.

Due to this configuration, since the flexible member closely contacts the floor at the bottom of the water, the water will not escape from the bottom of the strip body.

Note that the flexible member needs only to have a close contacting ability and may be made of any material. Therefore, as a preferred example, the third aspect of the invention provides a drain cleaner as set forth in claim 1 wherein the flexible member is a rubber member.

Effects of the Invention

As explained above, the drain cleaner of the present invention is comprised of a strip body and a reel body for reeling in or playing out this strip body to and from a rotary member. At the time of non-use, the strip body can be reeled into the reel body, so the device is superior in portability. As a result, it is extremely convenient for storage or transport.

Further, since just two workers can perform the water cleanup work for puddles etc. on large floors, the time consumed for cleanup work can be shortened and the manpower can be reduced.

In particular, according to the second and third aspects of the invention, since the flexible member closely contacts the floor etc. at the bottom of the water, there is the effect that substantially complete cleanup of water from puddles is possible.

DETAILED DESCRIPTION OF A PREFERRED EMBODIMENT

Below, the best embodiment of the present invention will be explained with reference to the drawings.

Figure 1:
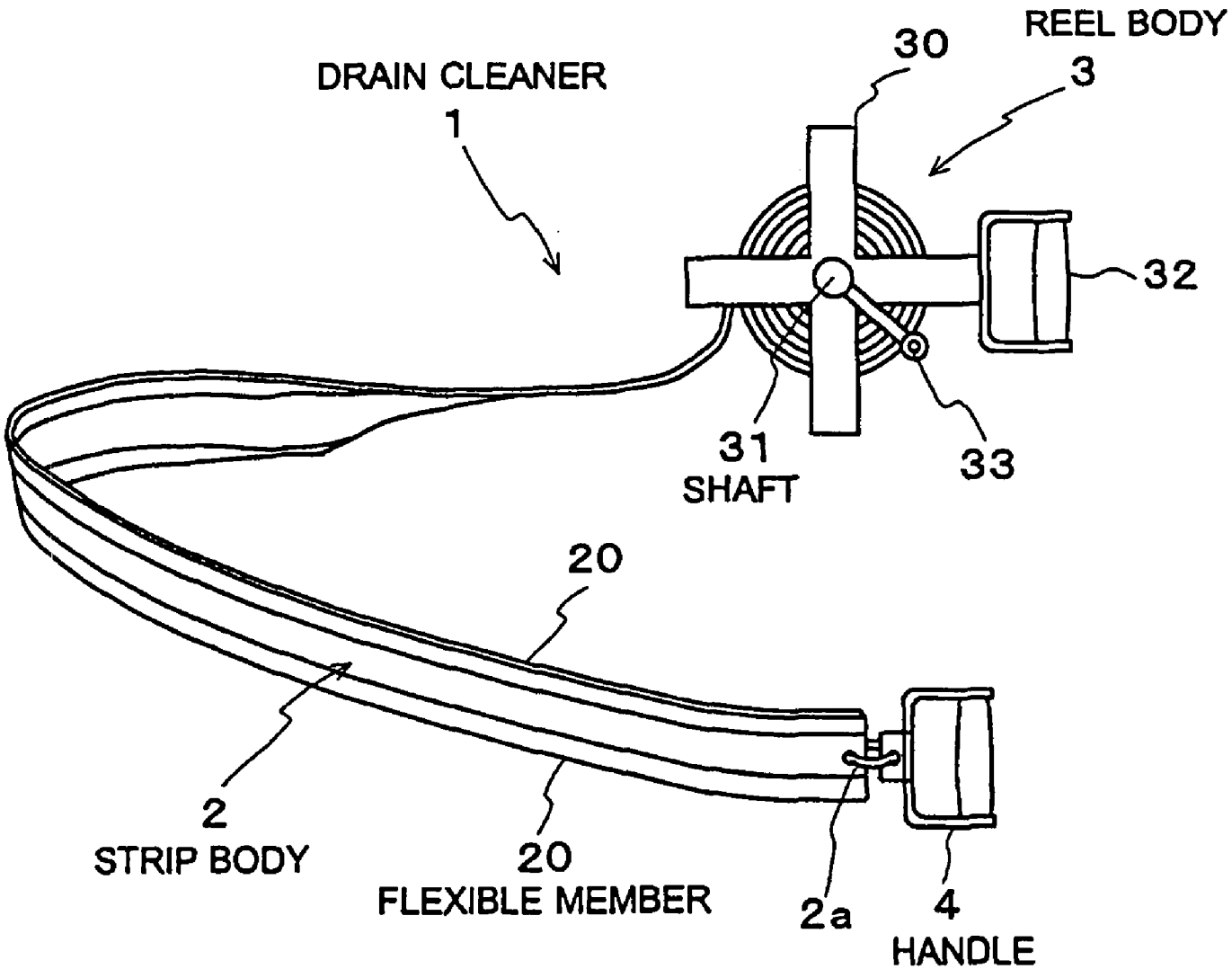
FIG. 1 is an external view of a drain cleaner according to an embodiment of the present invention.
Figure 2:
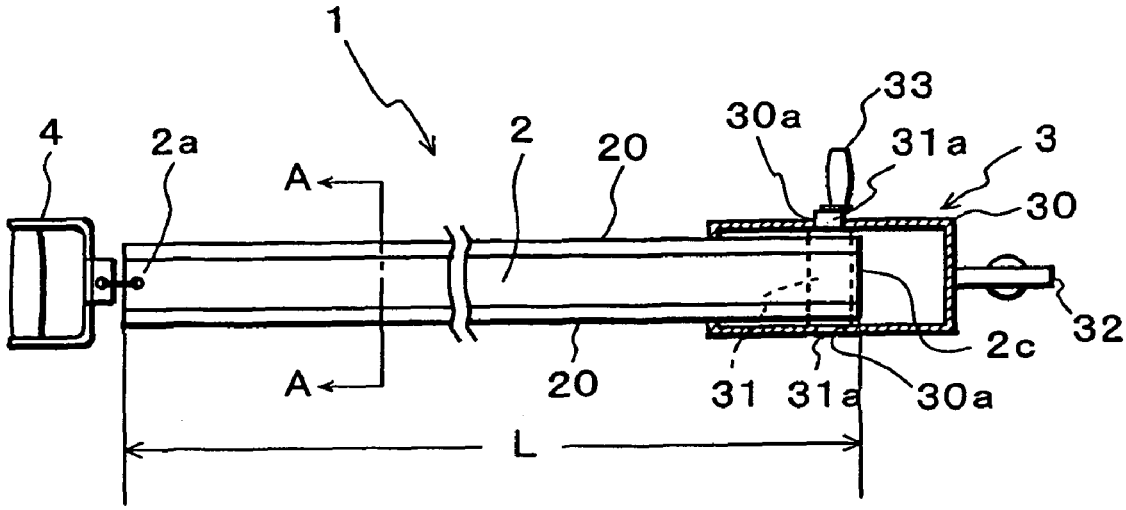
FIG. 2 is a plan view of a drain cleaner.
Figure 3:
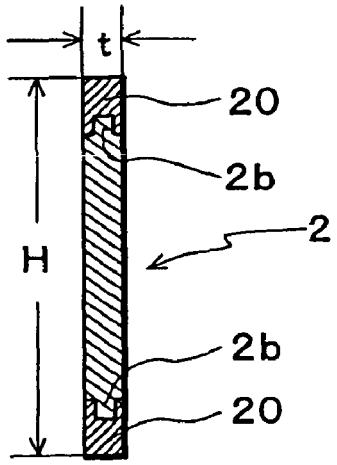
FIG. 3 is a cross-sectional view along the line A-A of FIG. 2.

FIG. 1 is an external view of a drain cleaner according to an embodiment of the present invention, FIG. 2 is a plan view of the same, and FIG. 3 is a cross-sectional view along the line A-A of FIG. 2.

As shown in FIG. 1 and FIG. 2, the drain cleaner 1 according to this embodiment is comprised of a strip body 2 and a reel body 3.

The strip body 2 is a long member of equal width for water cleanup having a handle 4 at its front end 2*a*.

The length L of playout of this strip body 2 from the reel body 3 is, in this embodiment, set to about 10 m. Further, as shown in FIG. 3, the width H of the strip body 2 is set to about 10 cm and the thickness t is set to about 3 mm.

Further, the two edges 2*b*, 2*b* of this strip body 2 are provided with flexible members 20, 20 with a high ability to closely contact the floor etc. Specifically, the strip body 2 itself is formed by glass fiber. On the other hand, the flexible members 20 are formed by rubber. The flexible members 20 are provided along the long direction of the strip body 2 (left-right direction of FIG. 2).

The rear end 2*c* of this strip body 2 is attached to the reel body 3.

Figure 4:
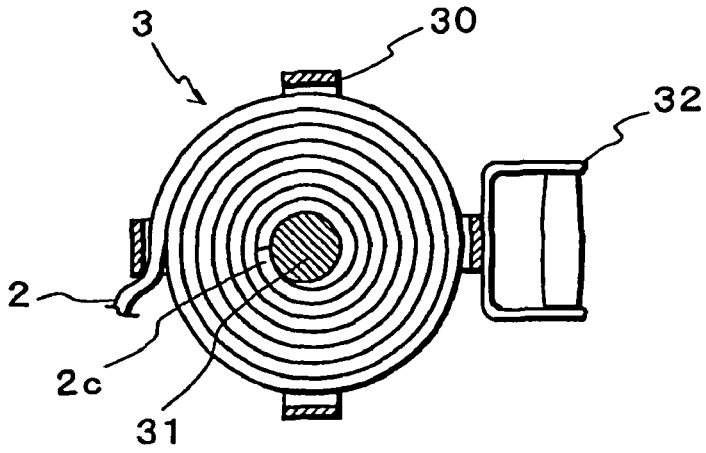
FIG. 4 is a cross-sectional view of a reel body.

FIG. 4 is a cross-sectional view of the reel body 3. This reel body 3 is a device for reeling in or playing out the strip body 2. As shown in FIG. 1 to FIG. 3 as well, it is comprised of a cross-shaped frame 30, a shaft 31 serving as a rotary member rotatably attached to the frame 30, and a handle 32 fixed to the outside of the frame 30.

Specifically, as shown in FIG. 2, the two ends 31*a*, 31*a* of the shaft 31 are rotatably fit into center holes 30*a* of the frame 30. A reel-in and reel-out lever 33 is attached to one end 31*a* of the shaft 31. Further, as shown in FIG. 4, the rear end 2*c* of the strip body 2 is fixed to the shaft 31.

Due to this, by turning the lever 33, the strip body 2 can be reeled into the reel body 3. Further, by holding the handle 4 and pulling the strip body 2, the strip body 2 can be played out from the reel body 3.

Next, an example of use of the drain cleaner according to this embodiment will be explained.

Figure 5:
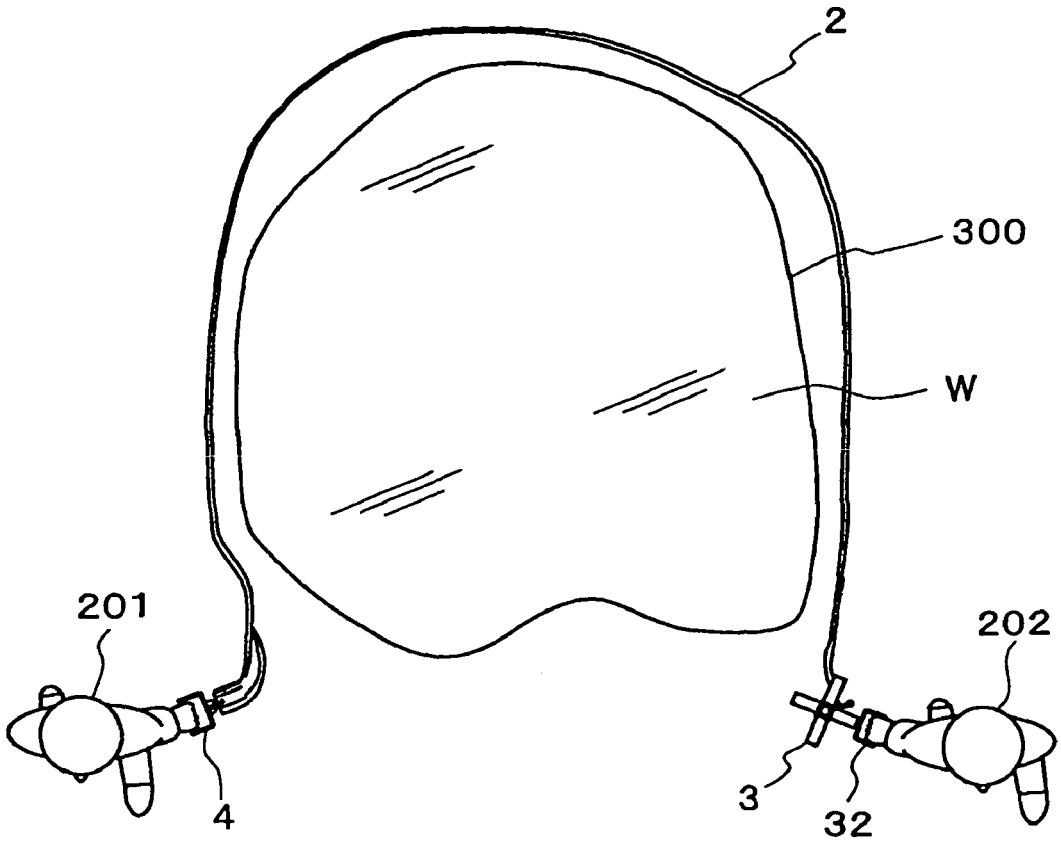
FIG. 5 is a schematic view of an example of water cleanup work using the drain cleaner of this embodiment.
Figure 6:
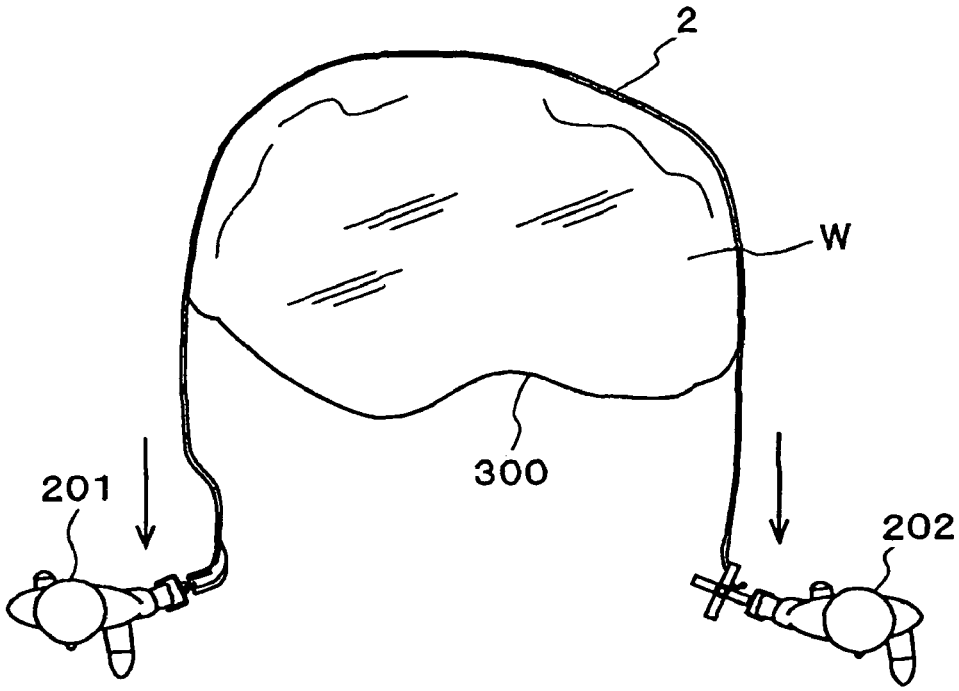
FIG. 6 is a schematic view of the state where the strip body of the drain cleaner traps water.

FIG. 5 is a schematic view of an example of water cleanup work using a drain cleaner 1 according to this embodiment, while FIG. 6 is a schematic view of the state of the strip body 2 of the drain cleaner 1 trapping water.

When using this drain cleaner 1 to clean water of a puddle, as shown in FIG. 5, the strip body 2 is played out from the reel body 3 to a length able to surround the puddle 300. Then, the handle 4 is gripped by one worker, while the handle 32 of the reel body 3 is held by another worker 202 and, in that state, the puddle 300 is surrounded by the strip body 2.

In this state, as shown in FIG. 6, if the workers 201, 202 proceed in the arrow direction so as to drag the strip body 2 behind them, the strip body 2 will trap the water of the puddle 300 from behind and move it toward the front.

Figure 7:
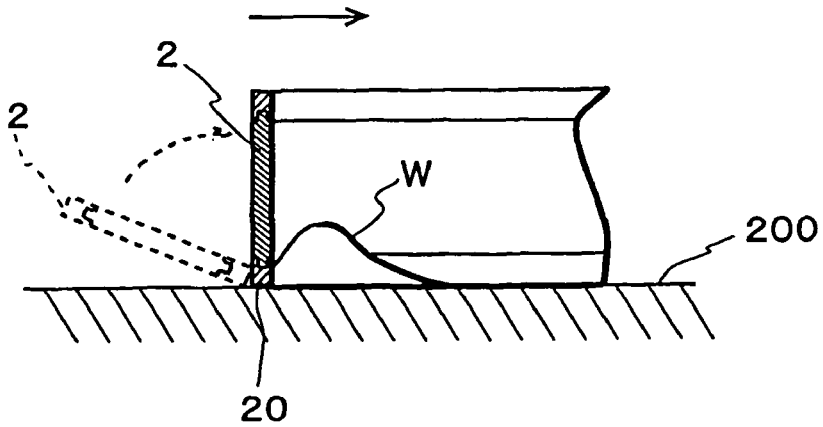
FIG. 7 is a cross-sectional view of the state of close contact of the strip body and the floor.

FIG. 7 is a cross-sectional view of the state where the strip body 2 traps water W of the puddle 300.

When the two workers 201, 202 pull the strip body 2, as shown in FIG. 7, the strip body 2 proceeds in the arrow direction while the bottom flexible member 20 is kept in close contact with the floor 200. Therefore, the strip body 2 pushes the water W in the direction of progression without allowing the water W to escape from between the floor 200 and the flexible member 20.

However, the floor 200 is not flat and has recessed parts and puddles 300. For this reason, a clearance is liable to form between the strip body 2 and the floor 200.

Figure 8:
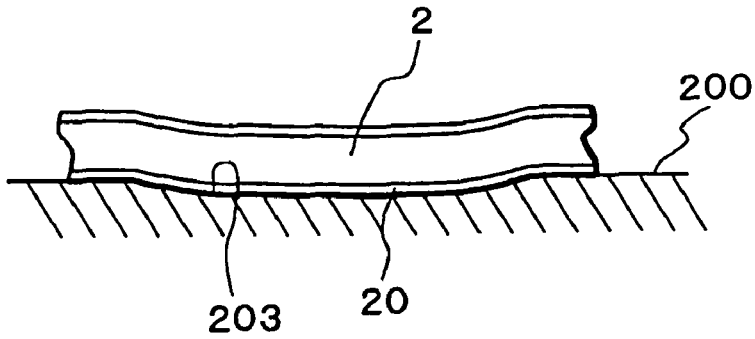
FIG. 8 is a cross-sectional view of the state of close contact of the strip body and a recessed part.
Figure 9:
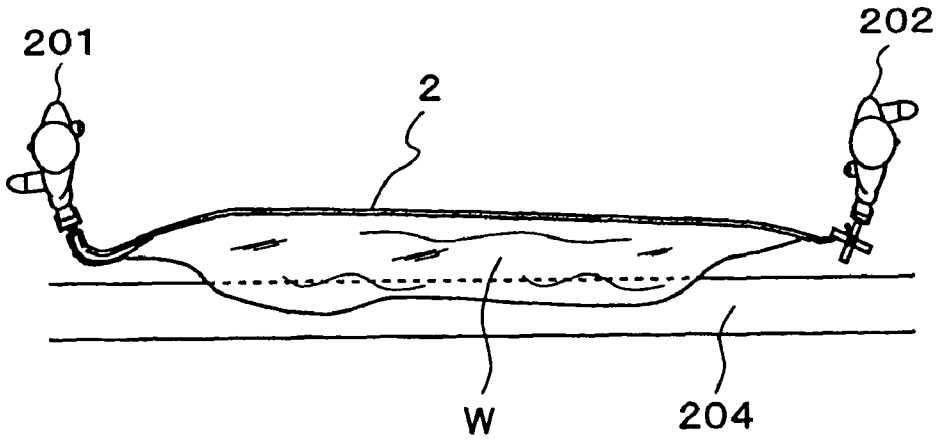
FIG. 9 is a schematic view of the state of the water trapped by the strip body being pushed into a drain.
Figure 10:
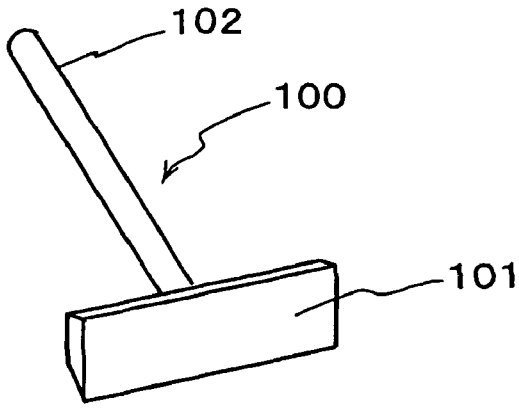
FIG.10 PRIOR ART
FIG. 10 is a perspective view of a conventional drain cleaner.
Figure 11:
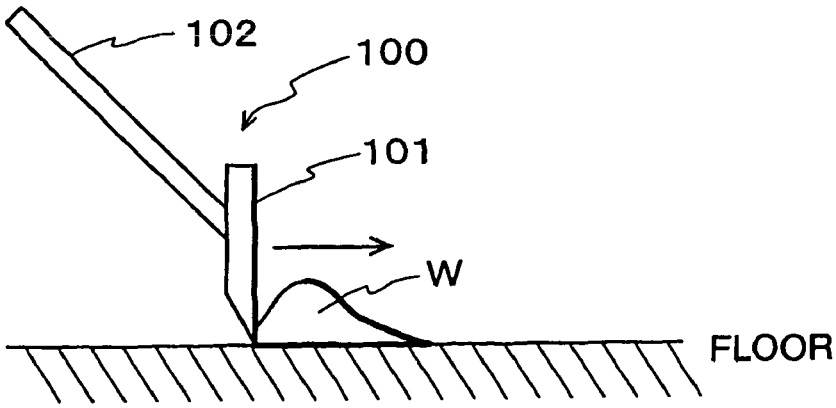
FIG. 11 is a view of an example of use of a conventional drain cleaner.

However, in the drain cleaner 1 according to this embodiment, the strip body 2 and flexible members 20 have flexibility and have lengths of 10 m, so, as shown in FIG. 8, the strip body 2 as a whole flexes in accordance with the shape of the recessed parts 203 and the flexible member 20 closely contacts the floor 200, so the water W is not allowed to escape.

Further, as shown by the broken line in FIG. 7, even if the strip body 2 is slanted before pulling, by pulling the strip body 2, the strip body 2 will stand up as shown by the solid line, so the water W will not escape over the top of the strip body 2.

In this way, the drain cleaner 1 reliably traps the water W of the puddle 300 by the strip body 2 and pushes the water W in the direction of progression of the workers 201, 202 without allowing the water W to escape from the bottom of the strip body 2.

The invention claimed is:

1. A drain cleaner comprising:

an equal width strip body having two edges disposed along a longitudinal direction of the strip body;

a reel body having a frame, a rotary member rotatably attached to the frame, and a handle attached to the rotary member, a rear end of the strip body being attached to the rotary member so that the strip body can be withdrawn from the reel body and wound onto the rotary member by rotating the handle; and flexible members disposed on both edges of the strip body, the flexible members having a high ability to closely contact a floor along the longitudinal direction of the strip body.

2. A drain cleaner as set forth in claim 1, further comprising a handle attached to a front end of the strip body for holding the front end, wherein said reel body further includes a handle attached to the reel body.

3. A drain cleaner as set forth in claim 2, wherein the strip body is formed of glass fiber.

* * * * *